US012509286B2

(12) United States Patent
Rosenbrien

(10) Patent No.: US 12,509,286 B2
(45) Date of Patent: Dec. 30, 2025

(54) ARTICLE TOP ENGAGING DEVICE, ARTICLE CARRIER AND BLANK THEREFOR

(71) Applicant: WESTROCK MWV, LLC, Atlanta, GA (US)

(72) Inventor: Cullen B. Rosenbrien, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 120 days.

(21) Appl. No.: 17/878,878

(22) Filed: Aug. 1, 2022

(65) Prior Publication Data

US 2022/0371800 A1 Nov. 24, 2022

Related U.S. Application Data

(63) Continuation of application No. 16/814,376, filed on Mar. 10, 2020, now Pat. No. 11,401,095.

(51) Int. Cl.
*B65D 71/44* (2006.01)

(52) U.S. Cl.
CPC ..... *B65D 71/44* (2013.01)

(58) Field of Classification Search
CPC ..... B65D 71/42; B65D 71/44; B65D 71/72
USPC ..... 206/139
See application file for complete search history.

(56) References Cited

U.S. PATENT DOCUMENTS 2,823,062 A 2/1958 Toensmeier
2,929,181 A 3/1960 Poupitch
2,936,070 A 5/1960 Poupitch
3,137,109 A 6/1964 Rapata
RE25,781 E 5/1965 Akiereb
3,242,631 A 3/1966 Whiteford
3,317,234 A 5/1967 Burford
3,404,912 A 10/1968 Watts
3,432,202 A 3/1969 Ebelhardt
3,515,272 A 6/1970 Von Gal
(Continued)

FOREIGN PATENT DOCUMENTS

AU 2009200835 A1 9/2009
DE 202018106535 1/2019
(Continued)

*Primary Examiner* — Anthony D Stashick
*Assistant Examiner* — Raven Collins
(74) *Attorney, Agent, or Firm* — Brian J. Goldberg; Tsugihiko Suzuki; Rohini K. Garg

(57) ABSTRACT

Aspects of the disclosure relate to an article top engaging device, a carrier for packaging one or more articles and a blank for forming the carrier. The article carrier 90 comprises an engaging panel 12 and an article top engaging device RT defined therein. The engaging panel 12 has at least one top-receiving opening defined by an aperture A1 defined therein and having a perimeter. The engaging panel 12 comprises a plurality of cut lines 20/22 each extending radially away from the perimeter. Each of the cut lines 20/22 comprises a linear portion 20 and an arcuate portion 22. The arcuate portion 22 is contiguously arranged with the linear portion 20. The engaging panel 12 comprises a fold line 18/19 extending between the linear portions 20 of adjacent pairs of the plurality of cut lines 20/22 so as to define engaging tabs 16 foldably connected to the engaging panel 12 and struck therefrom.

20 Claims, 4 Drawing Sheets

(56) References Cited

U.S. PATENT DOCUMENTS

| | | | | |
|---|---|---|---|---|
| 3,601,253 | A | 8/1971 | Poupitch | |
| 3,612,266 | A | 10/1971 | Graser | |
| 3,627,121 | A | 12/1971 | Dessy | |
| 3,664,497 | A | 5/1972 | Mascia | |
| 4,190,149 | A | 2/1980 | Oliff et al. | |
| 4,518,081 | A | 5/1985 | de Larosiere | |
| 4,911,289 | A | 3/1990 | Bird | |
| 5,103,971 | A | 4/1992 | Schuster | |
| 5,125,506 | A | 6/1992 | Galbierz et al. | |
| 5,135,104 | A | 8/1992 | Jorba | |
| 5,186,321 | A | 2/1993 | Fadus | |
| 5,188,225 | A | 2/1993 | Jorba | |
| 5,237,796 | A | 8/1993 | Bonkowski | |
| 5,263,299 | A | 11/1993 | Galbierz et al. | |
| 5,320,216 | A | 6/1994 | Pangborn | |
| 5,323,895 | A | 6/1994 | Sutherland et al. | |
| 5,415,278 | A * | 5/1995 | Sutherland | B65D 71/46 206/148 |
| 5,474,172 | A | 12/1995 | Zavatone et al. | |
| 5,485,914 | A | 1/1996 | Martin | |
| 5,487,464 | A * | 1/1996 | Galbierz | B65D 71/42 206/149 |
| 5,551,556 | A | 9/1996 | Sutherland | |
| 5,551,566 | A | 9/1996 | Sutherland | |
| 5,553,704 | A | 9/1996 | Gordon et al. | |
| 5,553,705 | A | 9/1996 | Bakx | |
| 5,573,111 | A | 11/1996 | Gordon et al. | |
| 5,706,936 | A | 1/1998 | Bernstein | |
| 5,711,419 | A | 1/1998 | Beales et al. | |
| 5,718,330 | A | 2/1998 | Auffret et al. | |
| 5,791,463 | A | 8/1998 | Negelen | |
| 5,791,464 | A | 8/1998 | Galbierz et al. | |
| 6,039,181 | A * | 3/2000 | Whiteside | B65D 71/125 206/427 |
| 6,168,012 | B1 | 1/2001 | Galbierz | |
| 6,293,392 | B1 | 9/2001 | Galbierz | |
| 6,658,815 | B1 | 12/2003 | Gaspar | |
| 8,113,968 | B2 | 2/2012 | Fittler | |
| 8,162,135 | B2 | 4/2012 | Oliveira | |
| 8,443,968 | B2 | 5/2013 | De Paula | |
| 8,469,184 | B2 * | 6/2013 | Spivey, Sr. | B65D 71/406 206/141 |
| 9,004,344 | B2 | 4/2015 | Smith | |
| 9,359,093 | B2 * | 6/2016 | DePaula | B65B 13/00 |
| D786,702 | S | 5/2017 | Borg et al. | |
| 10,293,998 | B2 | 5/2019 | Borg et al. | |
| 2004/0007480 | A1 | 1/2004 | Pattee et al. | |
| 2007/0193889 | A1 | 8/2007 | Olsen et al. | |
| 2010/0044257 | A1 * | 2/2010 | Morton | C09D 5/02 427/256 |
| 2010/0084289 | A1 * | 4/2010 | Willms | G09F 5/04 156/299 |
| 2016/0280436 | A1 | 9/2016 | Taylor et al. | |
| 2018/0222650 | A1 * | 8/2018 | Zacherle | B65D 71/50 |
| 2018/0362234 | A1 | 12/2018 | LHeureux et al. | |

FOREIGN PATENT DOCUMENTS

| | | | |
|---|---|---|---|
| EP | 0398835 | B1 | 10/1996 |
| EP | 1075419 | B1 | 10/2003 |
| EP | 2 067 713 | A1 | 6/2009 |
| ES | 2159235 | | 9/2001 |
| GB | 1427510 | | 3/1976 |
| WO | WO1993021083 | A | 10/1993 |
| WO | WO1997018993 | A1 | 5/1997 |
| WO | WO2009023822 | | 2/2009 |
| WO | WO2016/008744 | A1 | 1/2016 |

* cited by examiner

ARTICLE TOP ENGAGING DEVICE, ARTICLE CARRIER AND BLANK THEREFOR

CROSS-REFERENCE TO RELATED APPLICATIONS

The present application is a continuation of U.S. patent application Ser. No. 16/814,376 filed on Mar. 10, 2020, the contents of which is incorporated herein by reference in its entirety.

TECHNICAL FIELD

The present invention relates to article top engaging devices, article carriers and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides an article top engaging device for an article carrier. The article top engaging device comprises an engaging panel having at least one top-receiving opening defined, at least in part, by an aperture defined in the engaging panel and having a perimeter. The engaging panel comprises a plurality of cut lines each extending radially away from the perimeter. Each of the cut lines comprises a linear portion and an arcuate portion. The arcuate portion is contiguously arranged with the linear portion. The engaging panel comprises a fold line extending between the linear portions of adjacent pairs of the plurality of cut lines so as to define engaging tabs foldably connected to the engaging panel and struck therefrom.

Optionally, the fold line is at least defined in part by a crease line.

Optionally, the fold line is defined in part by at least one cut line.

Optionally, the fold line is defined in part by a cut line interrupting the crease line.

Optionally, the crease line comprises an embossed line.

Optionally, the crease line comprises a debossed line.

Optionally, the arcuate portion extends from an outer end of the linear portion and is curved so as to return towards the fold line.

Optionally, the arcuate portion comprises a first end proximate an outer end of the linear portion, and wherein the arcuate portion extends from an outer end of the linear portion and is curved so as to return towards the fold line and terminates at a second end, the second end being spaced apart from the fold line.

Optionally, the arcuate portion and at least a portion of the fold line define a lobe extension of a respective one of the engaging tabs.

Optionally, the perimeter of the aperture defines a polygon.

Optionally, the perimeter of the aperture defines a polygon having at least eight sides.

Optionally, the perimeter of the aperture defines a polygon having at least twelve sides.

Optionally, the fold lines define a polygon having at least eight sides.

Optionally, the fold lines define a polygon having at least twelve sides.

A second aspect of the invention provides an article carrier for packaging at least one article. The article carrier comprises a top panel including an article top engaging device having at least one top-receiving opening defined, at least in part, by an aperture defined in the top panel. The aperture comprises a perimeter. The top panel comprises a plurality of cut lines each extending radially away from the perimeter. Each of the cut lines comprises a linear portion and an arcuate portion. The arcuate portion is contiguously arranged with the linear portion. The top panel comprises a fold line extending between the linear portions of adjacent pairs of the plurality of cut lines so as to define engaging tabs foldably connected to the top panel and struck therefrom.

A third aspect of the invention provides a blank for forming an article carrier. The blank comprises a main panel including an article top engaging device having at least one top-receiving opening defined, at least in part, by an aperture defined in the main panel. The aperture comprises a perimeter. The main panel comprises a plurality of cut lines each extending radially away from the perimeter. Each of the cut lines comprises a linear portion and an arcuate portion. The arcuate portion is contiguously arranged with the linear portion. The main panel comprises a fold line extending between the linear portions of adjacent pairs of the plurality of cut lines so as to define engaging tabs foldably connected to the main panel and struck therefrom.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
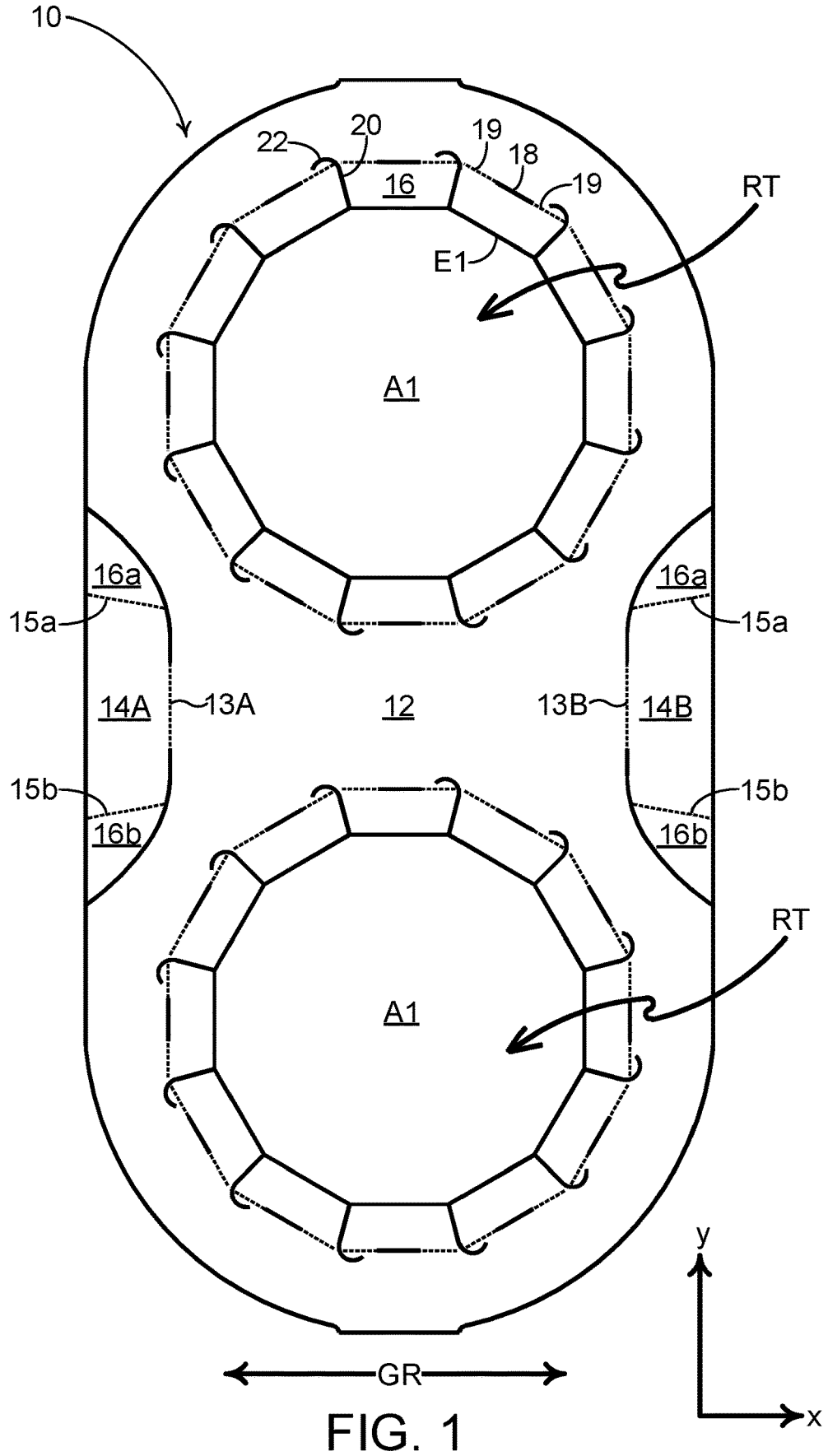
FIG. 1 is a plan view from above of a blank for forming a carrier according to a first embodiment.
Figure 2:
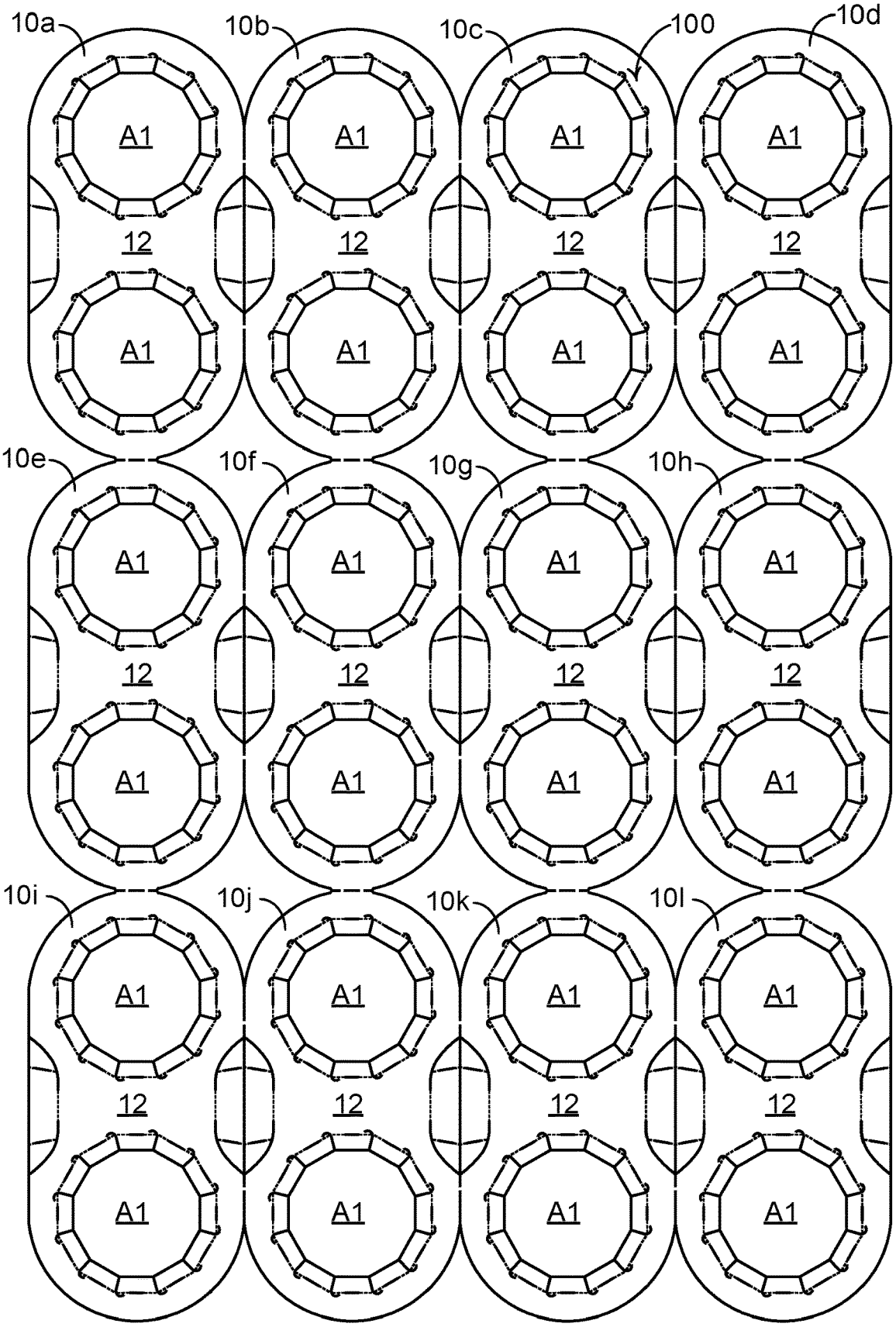
FIG. 2 is a plan view from above of a plurality of blanks of FIG. 1 connected together in an array.
Figure 3:
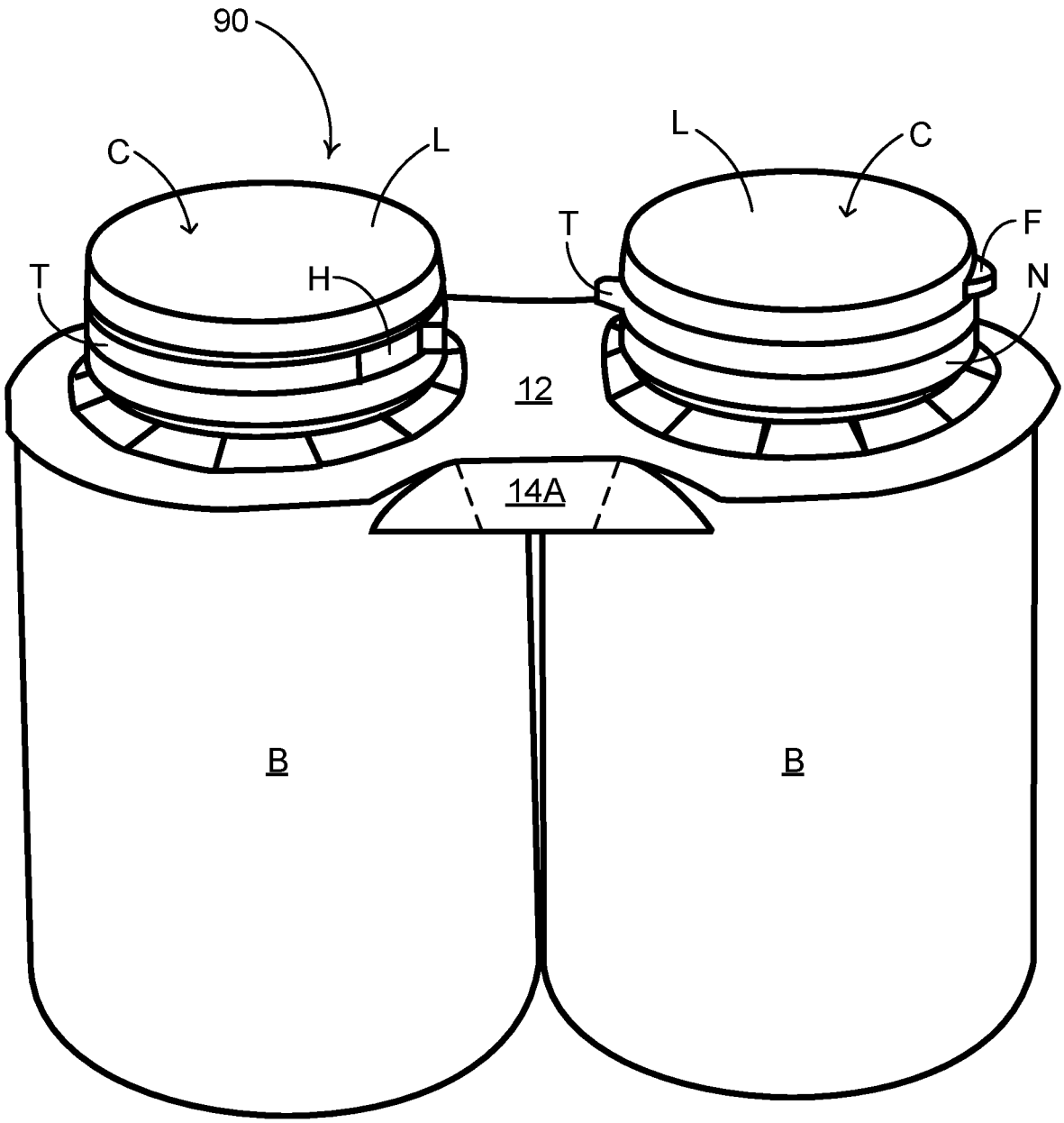
FIG. 3 is a perspective view from above of a carrier, formed from the blank of FIG. 1, engaging a group of articles.

Referring to FIG. 2, there is shown a plan view of a plurality of connected blanks 10A to 10L; an individual blank 10 is shown in FIG. 1 which is capable of forming a carton or carrier 90, as shown in FIG. 3, for containing and carrying a group of primary products such as, but not limited to, bottles or cans, hereinafter referred to as articles B, as shown in FIG. 3. The blank 10 forms a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blank 10 is configured to form a carton or carrier 90 for packaging an exemplary arrangement of exemplary articles B. In the embodiment illustrated, the arrangement is a 1×2 matrix or array; one row of two articles is provided, and the articles B are vitamin or pill bottles. Alternatively, the blank 10 can be configured to form a carrier for packaging other types, number and size of articles and/or for packaging articles in a different arrangement or configuration.

Referring to FIG. 2 there is shown a plurality of connected blanks referred to generally by reference sign 100, specifically there are twelve blanks 10A, 10B, 10C, 10D, 10E, 10F, 10G, 10H, 101, 10J, 10K, 10L arranged in a 4×3 matrix or array. Each blank 110A, 10B, 100, 10D, 10E, 10F, 10G, 10H, 101, 10J, 10K, 10L comprises a main panel 12 for forming a top wall or engaging panel of a carrier 90 (see FIG. 3). Each blank 10A, 10B, 100, 10D, 10E, 10F, 10G, 10H, 101, 10J, 10K, 10L is connected to at least two adjacent blanks 10A, 10B, 100, 10D, 10E, 10F by frangible connections.

The main panel 12 includes at least one article retention structure RT, see FIG. 1. In the illustrated embodiment the main panel 12 comprises a plurality of article retention structures RT, specifically two article retention structures RT arranged in 1×2 matrix or array. Each of the article retention structures RT comprises an aperture A1.

The blank 10 may be formed from a material having a grain or machine direction GR, the grain direction extends transversely of the blank 10, in a direction parallel with the lateral direction x and perpendicular to a longitudinal direction y of the blank 10, as indicated in FIG. 1. When the material is paper or paperboard, fibres (such as cellulose fibres) tend to be aligned due to the manufacturing process, this alignment defines the grain direction. The material is anisotropic, physical properties of the material are directionally dependent. For example, but not limited to, tear strength, fold endurance and stiffness are greater or higher across the grain direction, tensile strength is greater along the grain or machine direction.

Each of the article retention structures RT comprises an article receiving opening defined in part by an aperture A1.

The article retention structures RT comprise a plurality of teeth or tabs 16 disposed about the aperture A1. The plurality of tabs 16, or at least free edges thereof, may define a first regular dodecagon.

The aperture A1 and the plurality of tabs 16 define the article receiving opening, the plurality of tabs 16, or at least hinged edges thereof, define a second regular dodecagon. The second regular dodecagon is larger than the first regular dodecagon and is concentric therewith.

Each of the plurality of tabs 16 is hinged to the main panel 12 by a fold line. Each fold line may be defined in part by a cut line 18. The cut lines 18 may be linear and extend along a portion of a respective side of the second dodecagon.

Each of the fold lines may be defined in part by a pair of crease lines 19. In some embodiments the crease lines 19 are formed by embossed or debossed lines.

The pair of crease lines 19 are arranged collinearly with each other. The pair of crease lines 19 are arranged collinearly with a respective one of the cut lines 18.

Each of the plurality of tabs 16 comprises an engaging edge E1 opposing a hinged edge defined by the pair of crease lines 19 and the cut line 18. The engaging edges E1 are defined by a linear portion of a cut line defining the aperture A1. Each engaging edge E1 defines a part of the first dodecagon. The illustrated embodiment comprises twelve tabs 16 together defining the first dodecagon. Each tab 16 comprises a pair of side edges, the side edges are defined by cut lines 20 extending radially outward from respective vertices of the first dodecagon to an adjacent vertex of the second dodecagon.

The cut lines 20 are divergently arranged with respect to each other and define an angle therebetween, the angle may be about 30°.

The article retention structures RT comprise an arcuate cut 22 at each end of the radial cut lines 20. The arcuate cut 22 is arranged to be contiguous or continuous with one of the radial cut lines 20. The arcuate cuts 22, or at least a portion thereof, are disposed outside the tabs 16, the arcuate cuts 22 are disposed in the main panel 12 adjacent to one of the tabs 16. The arcuate cuts 22 are curved so as to return towards said one of the tabs 16. The arcuate cuts 22 terminate in a spaced apart relationship with one of the pair of crease lines 19.

Figure 4:
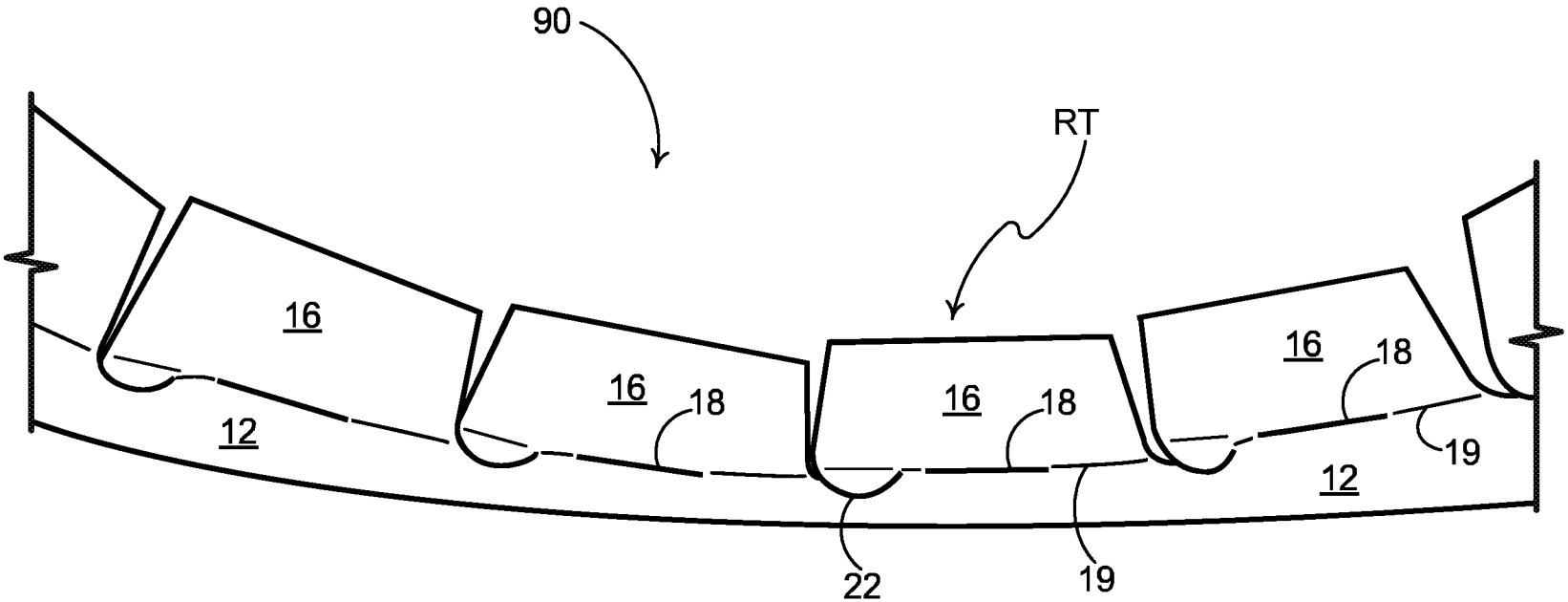
FIG. 4 is a perspective view from below showing a portion of an article retention structure, the article has been omitted for illustrative purposes.

In use a portion of the main panel 12 disposed between the arcuate cuts 22 and the adjacent one of the pair of crease lines 19 may be displaced out of the plane of the main panel 12 along with the tabs 16, best illustrated in FIG. 4 which shows a portion of an article retention structure RT from below in which the article B has been omitted for illustrative purposes.

The arrangement of cut lines 20 and arcuate cuts 20 has been found to be advantageous during die cutting of the blank 10. The cuts 20, 22 are more easily and reliably produced in the material. The arcuate cuts 22 reduce the likelihood of tear propagation outwardly of the article receiving openings. A further advantage of the cuts 20, 22 is that they do not produce small scrap-out areas which may cause problems during processing of the blank 10.

The main panel 12 may optionally comprise a handle structure. The handle structure may comprise a first handle flap 14A and a second handle flap 14B. The first handle flap 14A is struck from the main panel 12 along a first side thereof and is located in a region disposed centrally between the pair of article retention structures RT. The second handle flap 14B is struck from the main panel 12 along a second side, opposing the first side, and is located in a region disposed centrally between the pair of article retention structures RT.

The first handle flap 14A is hingedly connected to the main panel 12 by a hinged connection in the form of a fold line 13A. The second handle flap 14B is hingedly connected to the main panel 12 by a hinged connection in the form of a fold line 13B.

Each of the first and second handle flaps 14A, 14B comprises a pair of fold or crease lines 15*a*, 15*b* extending transversely thereacross. The fold lines 15*a*, 15*b* may be divergently arranged with respect to each other. Each of the fold lines 15*a*, 15*b* defines in part an end portion 16*a*, 16*b* of the respective first or second handle flap 14A, 14B in which it is defined. The fold lines 15*a*, 15*b* may facilitate folding of the first and second handle flaps 14A, 14B into a void or recess between the pair of articles B.

The main panel 12 includes at least a paperboard substrate. The material of the paperboard substrate may be selected from any conventional paperboard, for example, ranging in weight upwardly from about 10 pt., preferably from about 16 pt. to about 28 pt. (0.028"/~0.7 mm). An example of such a substrate is a 20 point (pt.) (0.020"/~0.5 mm) SBS board (solid bleached sulfate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The main panel 12 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

Turning to the construction of the carrier 90 from the blank 10, the blank 10 may be applied to a group of articles B. The blank 10 is lowered with respect to the group of articles B. Each of the article retention structures RT of the blank 10 is aligned with a respective article B in the group. Portions of the articles B pass through the main panel 12. The tabs 16 are folded out of the plane of the main panel 12.

The engaging edges E1 of the tabs 16 engage beneath a projection. The projection may be located about the neck or cap of the article B (which may provide a flange) of an article B. When the article B is a bottle the projection may be provided by an end closure. In other embodiments it may be provided by a ridge or undercut shaping of the article B. In this way, the engaging edges E1 grip or hold the article B and prevent or inhibit the article B from unintentionally separating from the main panel 12. The assembled carrier 90 is shown in FIG. 3.

The articles B may comprises a cap or end closure C comprising a hinged lid L coupled to a collar N by a hinge H. The collar N is mounted to a neck of a container. The end closure C may comprise a tamper evident feature such as a tear strip T which is severably connected to each of the hinged lid L and collar N. The hinged lid L may comprise a tab, recess or projection providing a lip or overhang to facilitate opening of the lid L. In the illustrated embodiment a boss or lobe F extends outwardly from a circumferential edge or side wall of the lid L.

A portion of the tamper evident tear strip T may project outward of the closure to provide a tear initiation device.

The end closure of the articles B has a maximum width dimension which is less than the diameter or width of the article receiving openings of the article retention structures RT. The article B comprises a main body portion having a maximum width dimension which is greater than the diameter or width of the article receiving openings.

Another optional feature of the carrier 90 is that the main panel 12 is defined by a perimeter to which no other part of the carrier 90 is connected. That is to say, the carrier 90 is free of connection to other panels for example, but not limited to, side or end wall panels which extend about the sides of the article group. The perimeter of the main panel 12 is therefore defined in its entirety by free, cut or unhinged edges.

In some embodiments the plurality of blanks 100 is applied simultaneously to a first group of articles B. The first group of articles B is divisible into a plurality of second groups of articles B. Each second group of articles B is thus formed from a subset of the first group of articles B. The embodiment illustrated in FIG. 1 the first group of articles B comprises twenty-four articles arranged in a 4×6 matrix or array, and each individual blank 10A to 10L accommodates two articles in a 1×2 matrix or array.

The frangible connections between the individual blanks 10 may separate upon application of the plurality of blanks 100 to the first group of articles B. Alternatively, the frangible connections may remain intact, individual blanks 10 may be separated from the others at a point of sale or distribution.

The present disclosure provides a carrier 90 of the top engaging type having improved article retention structures or article top engaging devices RT.

The article top engaging device RT comprises an engaging panel 12 having at least one top-receiving opening.

The present disclosure provides an article top engaging device RT for an article carrier 90 comprising an engaging panel 12. The engaging panel 12 has at least one top-receiving opening defined, at least in part, by an aperture A1 defined therein and having a perimeter. The engaging panel 12 comprises a plurality of cut lines 20/22 each extending radially away from the perimeter. Each of the cut lines 20/22 comprises a linear portion 20 and an arcuate portion 22. The arcuate portion 22 is contiguously arranged with the linear portion 20. The engaging panel 12 comprises a fold line 18/19 extending between the linear portions 20 of adjacent pairs of the plurality of cut lines 20/22 so as to define engaging tabs 16 foldably connected to the engaging panel 12 and struck therefrom.

The fold line 18/19 may be defined, at least in part, by a crease line 19. The fold line 18/19 may be defined in part by at least one cut line 18. The at least one cut line 18 may interrupt the crease line 19. The crease line 19 may comprise an embossed line or debossed line.

The arcuate portion 22 extends from an outer end of the linear portion 20 and is curved so as to return towards the fold line 18/19.

The arcuate portion 22 comprises a first end proximate an outer end of the linear portion 20. The arcuate portion 22 extends from an outer end of the linear portion 20. The arcuate portion 22 terminates at a second end, the second end may be spaced apart from the fold line 18/19.

The arcuate portion 22 and at least a portion of the fold line 18/19 define a lobe extension of a respective one of the engaging tabs 16.

The perimeter of the aperture A1 defines a polygon. The polygon may have at least eight sides. The polygon may have at least twelve sides.

The fold lines 18/19 define a polygon which may have at least eight sides. The fold lines 18/19 may define a polygon having at least twelve sides.

The present disclosure provides an article carrier 90 for packaging at least one article B. The article carrier 90 comprises a top panel having an article top engaging device RT. The article top engaging device RT has at least one top-receiving opening defined, at least in part, by an aperture Al in the top panel 12. The aperture A1 has a perimeter. The top panel 12 comprises a plurality of cut lines 20/22 each extending radially away from the perimeter. Each of the cut lines 20/22 comprises a linear portion 20 and an arcuate portion 22. The arcuate portion 22 is contiguously arranged with the linear portion 20. The top panel 12 comprises a fold line 18/19 extending between the linear portions 20 of adjacent pairs of the plurality of cut lines 20/22 so as to define engaging tabs 16 foldably connected to the top panel 12 and struck therefrom.

The present also disclosure provides a package comprising an article carrier 90 for packaging at least one article B, such as but not limited to, a pill bottle and may have a hinged lid. The article carrier 90 formed from a paperboard substrate such as, but not limited to, 20 pt (0.020"/–0.5 mm) NatraLock® Resist SBS-manufactured by WestRock® Company. The article carrier 90 comprises a top panel having an article top engaging device RT. The article top engaging device RT has at least one top-receiving opening defined, at least in part, by an aperture A1 in the top panel 12. The aperture A1 has a perimeter. The top panel 12 comprises a plurality of cut lines 20/22 each extending radially away from the perimeter. Each of the cut lines 20/22 comprises a linear portion 20 and an arcuate portion 22. The arcuate portion 22 is contiguously arranged with the linear portion 20. The top panel 12 comprises a fold line 18/19 extending between the linear portions 20 of adjacent pairs of the plurality of cut lines 20/22 so as to define engaging tabs 16 foldably connected to the top panel 12 and struck therefrom.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article top engaging device for an article carrier comprising:

an engaging panel having at least one top-receiving opening defined, at least in part, by an aperture defined in the engaging panel and having a perimeter, the engaging panel comprising:

a plurality of cut lines, each extending radially away from the perimeter, the plurality of cut lines including first and second cut lines, each of the first and second cut lines comprising a linear portion and an arcuate portion, the arcuate portion being contiguously arranged with the linear portion;

a first tab and a second tab, the first tab being disposed between the first and second cut lines, the second tab being disposed adjacent the first tab such that the second cut line is disposed between the first and second tabs, the arcuate portion of the first and second cut lines being disposed adjacent to the first and second tabs respectively and being curved to return towards the first and second tabs respectively.

2. An article top engaging device according to claim 1 wherein the arcuate portions of the first and second cut lines extend from respective outer ends of the linear portions of the first and second cut lines.

3. An article top engaging device according to claim 2 wherein each of the arcuate portions terminates at a point spaced apart from the fold line.

4. An article top engaging device according to claim 1 wherein the perimeter of the aperture defines a polygon.

5. An article top engaging device according to claim 1 wherein the perimeter of the aperture defines a polygon having at least eight sides.

6. A blank for forming an article carrier, the blank comprising a panel having a longitudinal direction, the panel including at least two top-receiving openings each defined, at least in part, by an aperture in the panel, the aperture having a perimeter, the panel comprising a plurality of tabs, each of the tabs coupled to the panel by a respective fold line and a plurality of cut lines each extending radially away from the perimeter and extending beyond the fold line, the at least two top-receiving openings being disposed along the longitudinal direction and configured to engage respective articles, the panel being formed from a material having a grain direction extending transversely of the longitudinal direction.

7. A blank for forming an article carrier, the blank comprising:

a main panel including an article top engaging device having at least one top-receiving opening defined, at least in part, by an aperture defined in the main panel, the aperture having a perimeter, the main panel comprising:

a plurality of cut lines each extending radially away from the perimeter, the plurality of cut lines including a first cut line and a second cut line, each of the first and second cut lines comprising a linear portion and an arcuate portion, the arcuate portion being contiguously arranged with the linear portion;

a first tab and a second tab, the first tab being disposed between the first and second cut lines, the second tab being disposed adjacent the first tab such that the second cut line is disposed between the first and second tabs, the arcuate portion of the first and second cut lines being disposed adjacent to the first and second tabs respectively and being curved to return towards the first and second tabs respectively.

8. A blank according to claim 7 wherein the first tab is foldably connected to the main panel by a fold line.

9. A blank according to claim 8 wherein the fold line is defined at least in part by a crease line.

10. A blank according to claim 8 wherein the fold line is defined in part by at least one cut line.

11. A blank according to claim 9 wherein the fold line is defined in part by a cut line interrupting the crease line.

12. A blank according to claim 9 wherein the crease line comprises an embossed line or a debossed line.

13. A blank according to claim 7, wherein the main panel comprises fold lines that each extends between the linear portions of adjacent pairs of the plurality of cut lines, respectively, so as to define a plurality of tabs foldably connected to the engaging panel and struck therefrom, the plurality of tabs comprising the first tab and the second tab, wherein the fold lines define a perimeter spaced radially outward from the aperture.

14. A blank according to claim 8 wherein the arcuate portion of the first cut line and at least a portion of the fold line define a lobe extension of the first tab.

15. A blank according to claim 13 wherein the fold lines define a polygon having at least eight sides.

16. An article top engaging device according to claim 1 wherein the first tab is foldably connected to the engaging panel by a fold line.

17. An article top engaging device according to claim 16 wherein the fold line comprises a cut line.

18. An article top engaging device according to claim 17 wherein the fold line further comprises a crease line arranged collinearly with the cut line.

19. A blank according to claim 6, further comprising:

a handle structure disposed at least in part between two of the top-receiving openings in the longitudinal direction, wherein the handle structure comprises a first handle flap hingedly connected to the main panel and a second handle flap hingedly connected to the main panel, wherein the first handle flap and the second handle flap are substantially in alignment in the longitudinal direction with a transverse distance therebetween.

20. A blank for forming an article carrier, the blank comprising:

a panel having a longitudinal direction, the panel including at least two top-receiving openings each defined, at least in part, by an aperture in the panel, the aperture having a perimeter, the at least two top-receiving openings being disposed along the longitudinal direction and configured to engage respective article;

a handle structure disposed on a portion of the panel at least in part between two of the top-receiving openings in the longitudinal direction, wherein the handle structure comprises a first handle flap hingedly connected to the panel and a second handle flap hingedly connected to the panel, wherein the first handle flap and the second handle flap are substantially aligned in the longitudinal direction with a transverse distance therebetween, wherein the first handle flap and the second handle flap are configured such that, in the formed article carrier, the first handle flap comprises a free edge opposing its hinged connection and the second handle flap comprises a free edge opposing its hinged connection.

* * * * *